US008188387B2

(12) United States Patent
Lo et al.

(10) Patent No.: US 8,188,387 B2
(45) Date of Patent: May 29, 2012

(54) KEYSWITCH AND KEYBOARD

(75) Inventors: Kan-Ping Lo, Taichung County (TW); Wen-Yu Tsai, Changhua County (TW); Lei-Lung Tsai, Taipei County (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 268 days.

(21) Appl. No.: 12/784,453

(22) Filed: May 20, 2010

(65) Prior Publication Data

US 2011/0226600 A1 Sep. 22, 2011

(30) Foreign Application Priority Data

Mar. 19, 2010 (TW) ..... 99204888 U

(51) Int. Cl.
*H01H 9/26* (2006.01)

(52) U.S. Cl. ..... 200/5 A

(58) Field of Classification Search ..... 200/5 A, 200/512, 517, 341, 344, 345, 51 R, 51.02; 400/490, 491, 491.2, 495.1, 495, 496
See application file for complete search history.

(56) References Cited

U.S. PATENT DOCUMENTS

| | | | | |
|---|---|---|---|---|
| 5,519,569 | A * | 5/1996 | Sellers | 361/679.15 |
| 6,781,077 | B2 * | 8/2004 | Olodort et al. | 200/344 |
| 7,057,125 | B1 * | 6/2006 | Tsai | 200/310 |
| 7,319,202 | B2 | 1/2008 | Sato | |
| 7,709,760 | B2 * | 5/2010 | Chen et al. | 200/314 |

* cited by examiner

*Primary Examiner* — Edwin A. Leon
(74) *Attorney, Agent, or Firm* — Winston Hsu; Scott Margo

(57) ABSTRACT

A keyswitch includes a key cap, a base, a first support member, a second support member and a link member. The base has a first restraining portion and a third restraining portion. The first support member is disposed between the key cap and the base. The first support member has a second restraining portion. The first restraining portion restrains the second restraining portion from moving in a direction perpendicular to the base. The second support member is disposed between the key cap and the base and opposite to the first support member. The second support member has a fourth restraining portion. The third restraining portion restrains the fourth restraining portion from moving in the direction perpendicular to the base. When the key cap is pressed to a bottom of the base, the second and fourth restraining portions are located under the first and third restraining portions respectively.

16 Claims, 8 Drawing Sheets

KEYSWITCH AND KEYBOARD

BACKGROUND OF THE INVENTION

1. Field of the Invention

The invention relates to a keyswitch and a keyboard and, more particularly, to a keyswitch applied to a slim keyboard.

2. Description of the Prior Art

A keyboard, which is the most common input device, can be found in variety of electronic equipments for users to input characters, symbols, numerals and so on. From consumer electronic products to industrial machine tools are all equipped with a keyboard for purpose of operation.

Referring to FIG. 1, FIG. 1 is a schematic diagram illustrating a conventional keyswitch 1. As shown in FIG. 1, the keyswitch 1 comprises a key cap 10, a scissor-type support mechanism 12 and a base 14. The scissor-type support mechanism 12 comprises two support members 120 and 122. The support members 120 and 122 are disposed between the key cap 10 and the base 14 to support the key cap 10. The key cap 10 is capable of moving vertically relative to the base 14 together with the scissor-type support mechanism 12.

Each of opposite sides of the support member 120 is formed as a pivoting hole, and each of opposite sides of the support member 122 has a pivoting shaft corresponding to the pivoting hole of the support member 120. Operators need to pull out the opposite sides of the support member 120 manually in assembly and then insert the pivoting shaft of the support member 122 into the pivoting hole of the support member 120. However, since the size of the keyswitch 1 gets smaller, the assembly procedure mentioned above gets harder. Besides, if the force for pulling out the opposite sides of the support member 120 is too large, it may cause damage to the support member 120. Furthermore, when the conventional scissor-type support mechanism 12 is applied to a slim keyswitch, it may get weak linking effect inside the slim keyswitch.

SUMMARY OF THE INVENTION

Therefore, an objective of the invention is to provide a keyswitch applied to a slim keyboard.

According to one embodiment, a keyswitch of the invention comprises a key cap, a base, a first support member, a second support member and a link member. The first support member has a first end portion and a second end portion. The first end portion is slidably disposed on the base. The second end portion is pivotally connected to the key cap. The second support member is disposed opposite to the first support member. The second support member has a third end portion and a fourth end portion. The third end portion is slidably disposed on the base. The fourth end portion is pivotally connected to the key cap. The link member has a fifth end portion, a sixth end portion and a seventh end portion. The seventh end portion is between the fifth and sixth end portions. The fifth and sixth end portions are slidably disposed on the base respectively. The seventh end portion is pivotally connected to the key cap. The first and second support members are located between the fifth and sixth end portions respectively.

Another objective of the invention is to provide a keyboard comprising a casing and a plurality of keyswitches disposed on the casing. The structure of one of the keyswitches of the keyboard is mentioned above.

As mentioned in the above, since the first support member, the second support member and the link member can be assembled between the key cap and the base respectively, the keyswitch of the invention can be assembled and miniaturized easily. Furthermore, the link member can effectively drive the movement of opposite ends of the key cap while the keyswitch is miniaturized. When a user presses one end of the key cap, the link member can make the key cap move up and down with respective to the base levelly.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
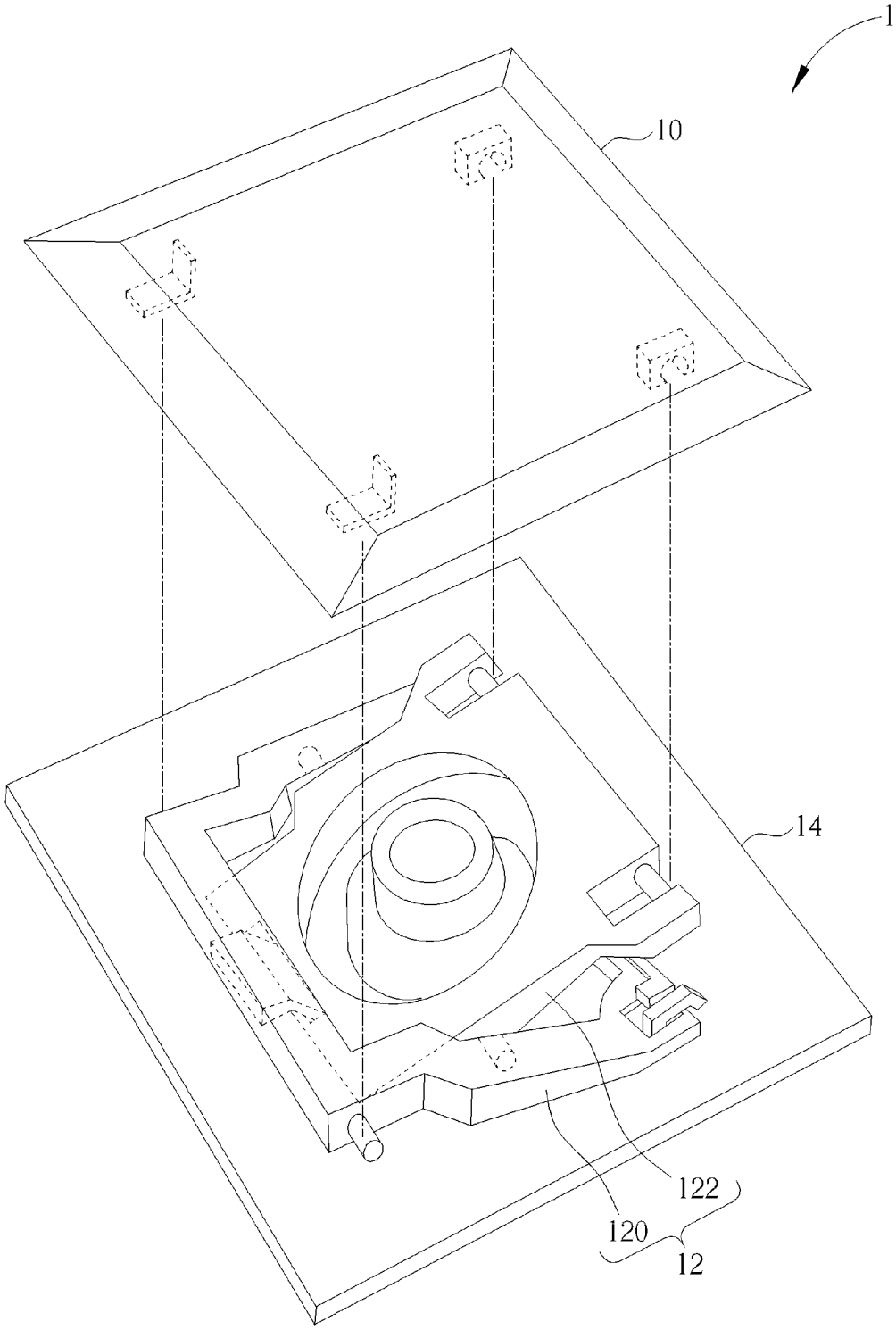
FIG. 1 PRIOR ART
FIG. 1 is a schematic diagram illustrating a conventional keyswitch.
Figure 2:
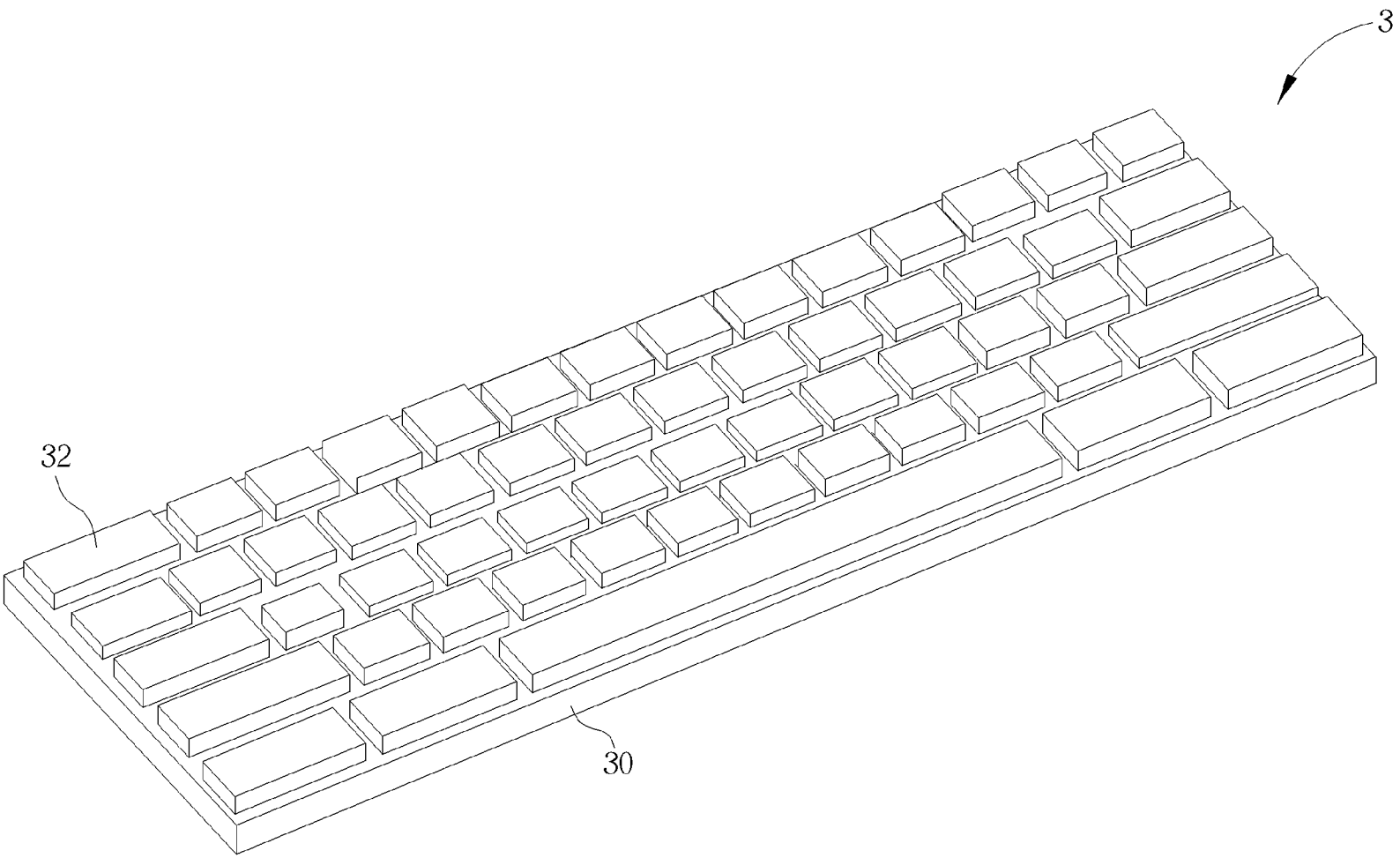
FIG. 2 is a schematic diagram illustrating a keyboard according to one embodiment of the invention.

Referring to FIG. 2, FIG. 2 is a schematic diagram illustrating a keyboard 3 according to one embodiment of the invention. As shown in FIG. 2, the keyboard 3 comprises a casing 30 and a plurality of keyswitches 32. The keyswitches 32 are disposed on the casing 30 for a user to press, so as to execute function correspondingly. In this embodiment, the keyboard 3 can be, but not limited to, a slim keyboard. The keyswitch 32 can be, but not limited to, a miniaturized keyswitch.

Figure 3:
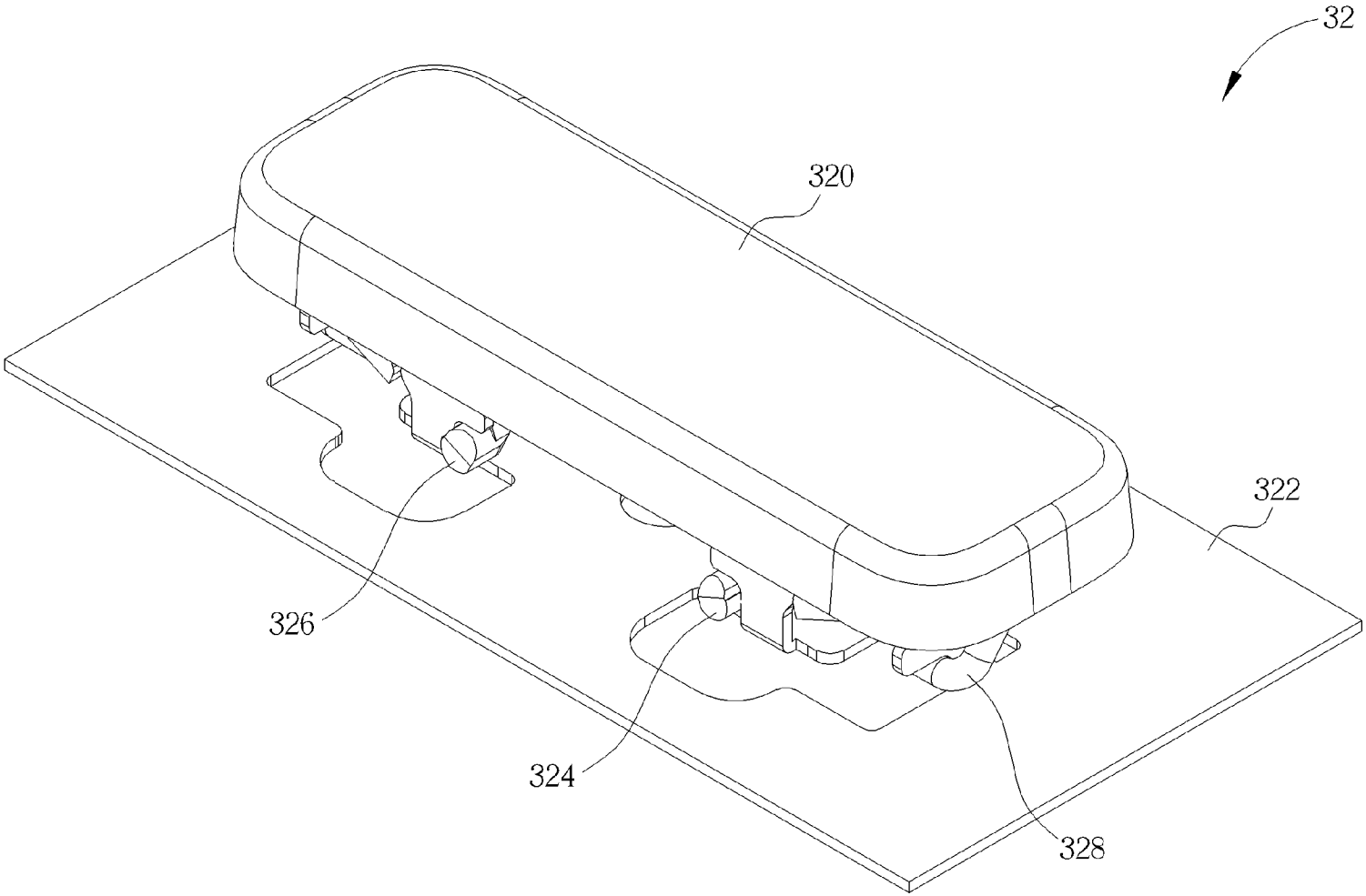
FIG. 3 is a perspective view illustrating one of the keyswitches of FIG. 2.
Figure 4:
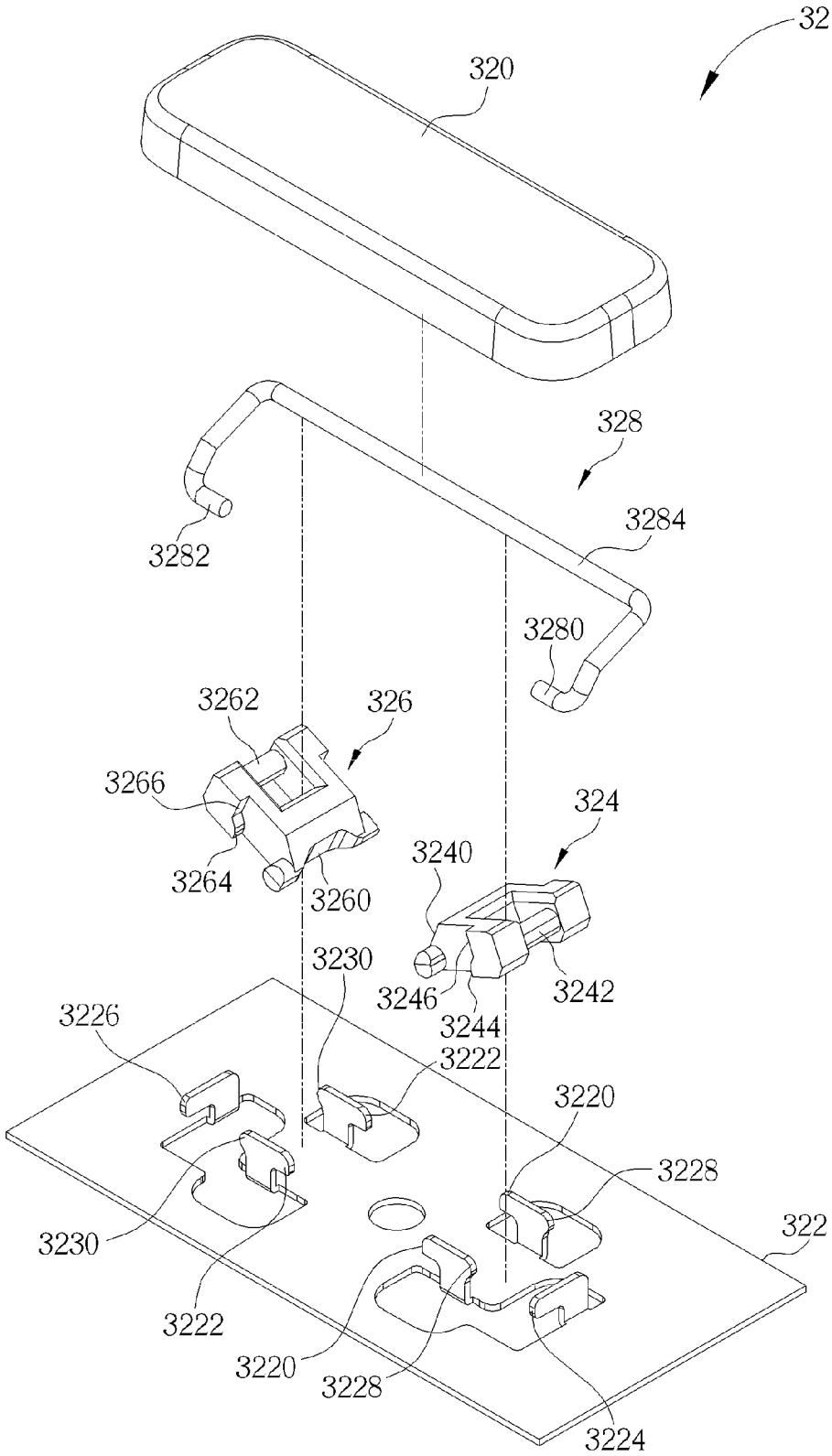
FIG. 4 is an exploded view illustrating the keyswitch of FIG. 3.
Figure 5:
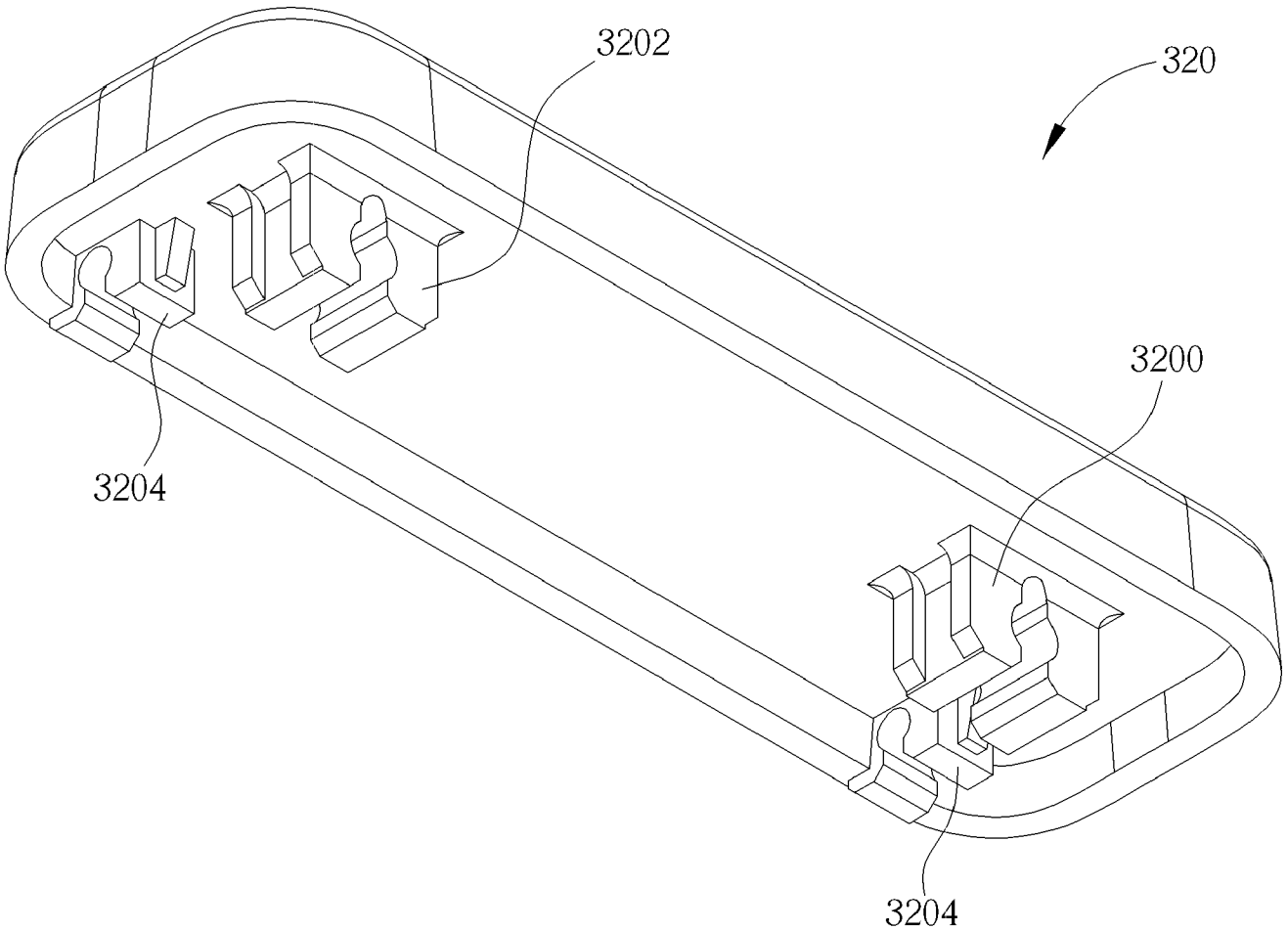
FIG. 5 is a perspective view illustrating the key cap of FIG. 4 in another view angle.

Referring to FIG. 3, FIG. 4 and FIG. 5, FIG. 3 is a perspective view illustrating one of the keyswitches 32 of FIG. 2, FIG. 4 is an exploded view illustrating the keyswitch 32 of FIG. 3, and FIG. 5 is a perspective view illustrating the key cap 320 of FIG. 4 in another view angle. As shown in FIG. 3 and FIG. 4, the keyswitch 32 comprises a key cap 320, a base 322, a first support member 324, a second support member 326 and a link member 328. In this embodiment, the base 322 has two opposite first engaging portions 3220, two opposite third engaging portions 3222, a fifth engaging portion 3224 and a sixth engaging portion 3226.

As shown in FIG. 4, two first restraining portions 3228 protrude from the two first engaging portions 3220 correspondingly, and two third restraining portions 3230 protrude from the two third engaging portions 3222 correspondingly. In other words, in this embodiment, the first restraining portion 3228 and the first engaging portion 3220 can be formed integrally, and the third restraining portion 3230 and the third engaging portion 3222 can be formed integrally. In another embodiment, the first restraining portion 3228 and the first engaging portion 3220 can be formed on the base 322 independently, the third restraining portion 3230 and the third engaging portion 3222 can be formed on the base 322 independently, and it depends on practical application.

As shown in FIG. 5, the key cap 320 has a second engaging portion 3200, a fourth engaging portion 3202 and two seventh engaging portions 3204. In this embodiment, the second engaging portion 3200, the fourth engaging portion 3202 and the seventh engaging portion 3204 can be formed as a pivoting hole with an opening.

Referring to FIG. 4 again, the first support member 324 has a first end portion 3240 and a second end portion 3242, and the second support member 326 has a third end portion 3260 and a fourth end portion 3262. When assembling the first support member 324, two opposite pivoting shafts of the first end portion 3240 can be slidably disposed in the two first engaging portions 3220 of the base 322 correspondingly. Similarly, when assembling the second support member 326, two opposite pivoting shafts of the third end portion 3260 can be slidably disposed in the two third engaging portions 3222 of the base 322 correspondingly. Accordingly, the first support member 324 and the second support member 326 can be disposed on opposite sides of the base 322. Besides, the second end portion 3242 has a pivoting shaft pivotally connected to a pivoting hole of the second engaging portion 3200 of the key cap 320, and the fourth end portion 3262 has a pivoting shaft pivotally connected to a pivoting hole of the fourth engaging portion 3202 of the key cap 320. In assembly, the second end portion 3242 of the first support member 324 can be pivotally connected to the second engaging portion 3200 of the key cap 320, and the fourth end portion 3262 of the second support member 326 can be pivotally connected to the fourth engaging portion 3202 of the key cap 320.

The link member 328 has a fifth end portion 3280, a sixth end portion 3282 and a seventh end portion 3284. In this embodiment, the seventh end portion 3284 is between the fifth end portion 3280 and the sixth end portion 3282, such that the link member 328 is substantially U-shaped. In assembly, the fifth end portion 3280 is slidably disposed in the fifth engaging portion 3224 of the base 322, the sixth end portion 3282 is slidably disposed in the sixth engaging portion 3226 of the base 322, and opposite sides of the seventh end portion 3284 are pivotally connected to opposite sides of the seventh engaging portion 3204 of the key cap 320 correspondingly.

Figure 6:
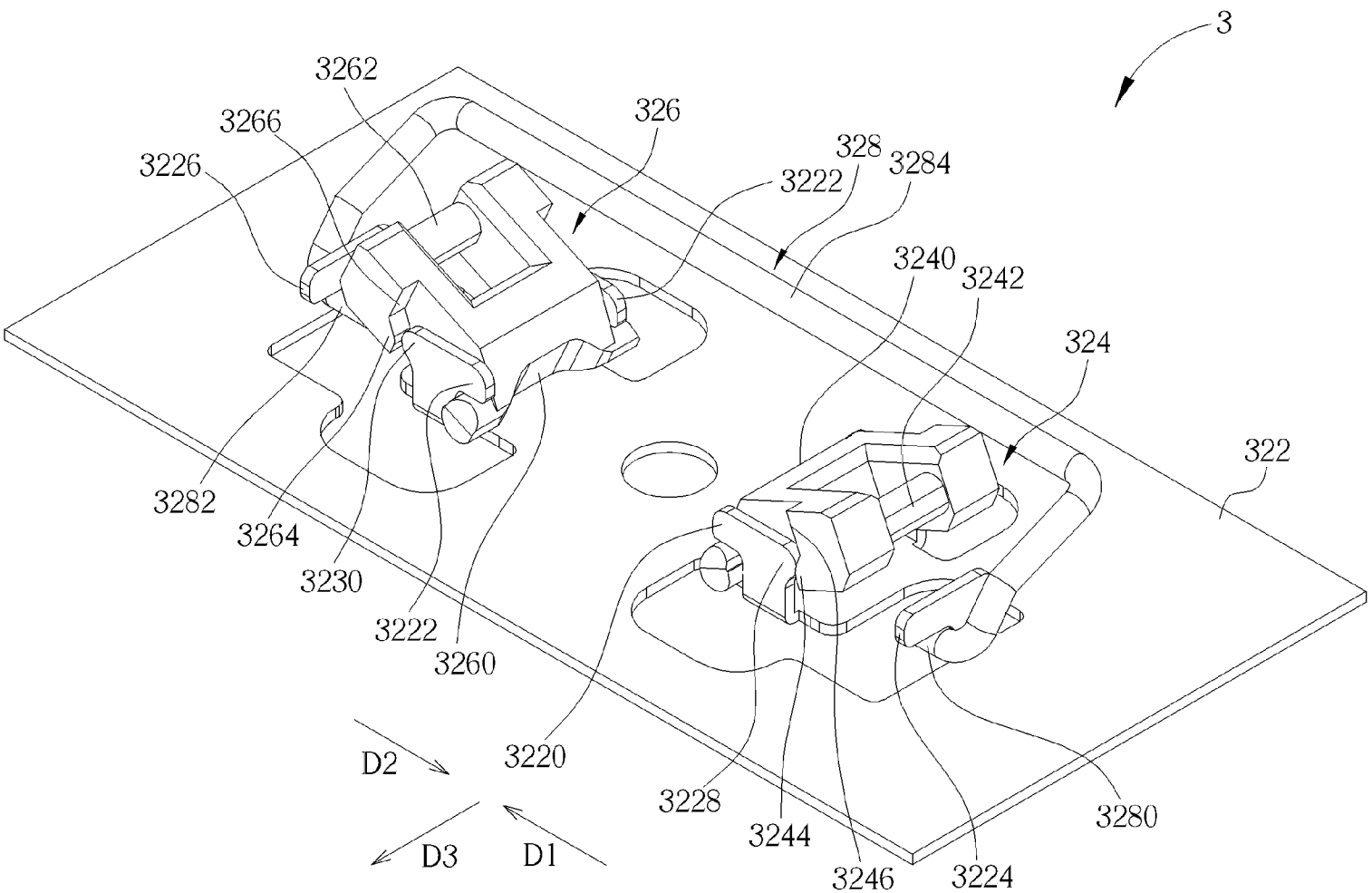
FIG. 6 is a schematic diagram illustrating the keyswitch of FIG. 3 removing the key cap.

Referring to FIG. 6, FIG. 6 is a schematic diagram illustrating the keyswitch 32 of FIG. 3 removing the key cap 320. As shown in FIG. 6, the first end portion 3240 of the first support member 324 is slidable in a first direction D1 relative to the base 322, the third end portion 3260 of the second support member 326 is slidable in a second direction D2 relative to the base 322, and the fifth end portion 3280 and the sixth end portion 3282 of the link member 328 are slidable in a third direction D3 relative to the base 322. In this embodiment, the first direction D1 is opposite to the second direction D2, and the third direction D3 is perpendicular to the first direction D1 and the second direction D2. In other words, after finishing the assembly of the keyswitch 3, when the user presses the key cap 320, the key cap 320 can move vertically relative to the base 322 together with the first support member 324, the second support member 326 and the link member 328. Besides, the first support member 324 and the second support member 326 are located between the fifth end portion 3280 and the sixth end portion 3282 respectively. When the user presses one end of the key cap 320, the link member 328 can make the key cap 320 move up and down with respective to the base 322 levelly.

Figure 7:
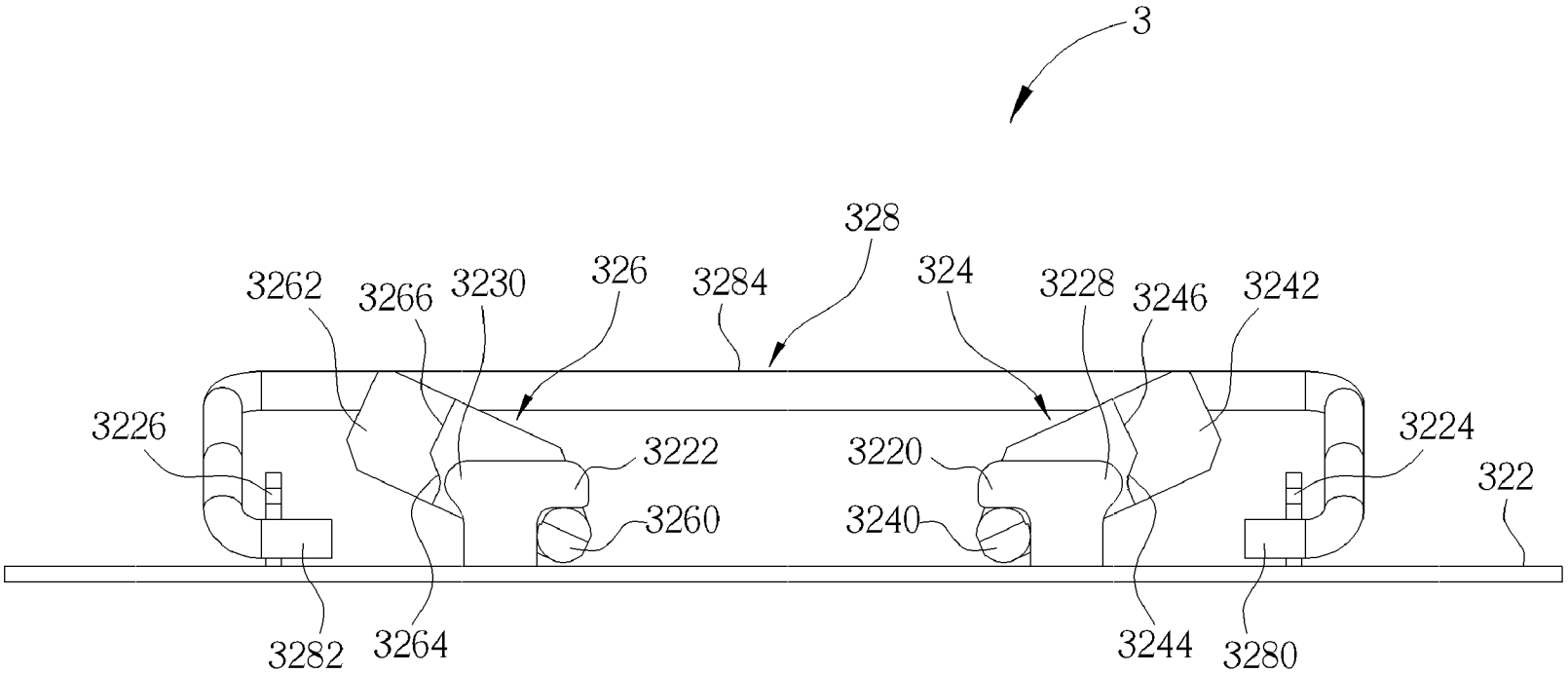
FIG. 7 is a side view illustrating the keyswitch of FIG. 6.
Figure 8:
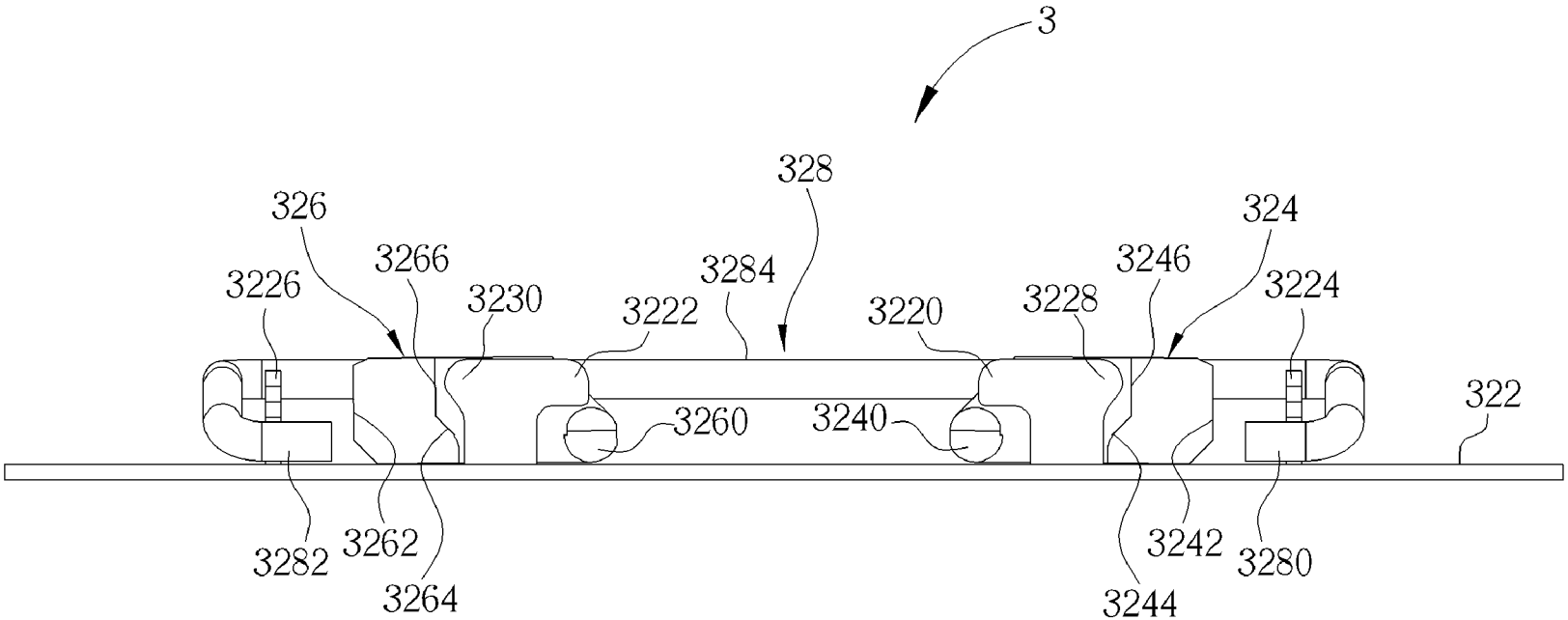
FIG. 8 is side view illustrating the keyswitch of FIG. 7 after being pressed.

Referring to FIG. 7 and FIG. 8, FIG. 7 is a side view illustrating the keyswitch 3 of FIG. 6, and FIG. 8 is a side view illustrating the keyswitch 3 of FIG. 7 after being pressed. Referring to FIG. 4 and FIG. 6, the first support member 324 further has a second restraining portion 3244 and a fifth restraining portion 3246, and the second support member 326 further has a fourth restraining portion 3264 and a sixth restraining portion 3266. As shown in FIG. 8, when the key cap 320 (not shown in FIG. 8, referring to FIG. 3) is pressed to a bottom of the base 322, the second restraining portion 3244 of the first support member 324 is located under the first restraining portion 3228 of the base 322, and the fourth restraining portion 3264 of the second support member 326 is located under the third restraining portion 3230 of the base 322. At this time, the first restraining portion 3228 restrains the second restraining portion 3244 from moving in a direction perpendicular to the base 322, so as to prevent the second end portion 3242 of the first support member 324 from departing from the base 322. Also, the third restraining portion 3230 restrains the fourth restraining portion 3264 from moving in a direction perpendicular to the base 322, so as to prevent the fourth end portion 3262 of the second support member 326 from departing from the base 322. Furthermore, the first restraining portion 3228 restrains the fifth restraining portion 3246 from moving in a direction parallel to the base 322, so as to prevent the first end portion 3240 of the first support member 324 from departing from the first engaging portion 3220. Also, the third restraining portion 3230 restrains the sixth restraining portion 3266 from moving in the direction parallel to the base 322, so as to prevent the third end portion 3260 of the second support member 326 from departing from the third engaging portion 3222.

After releasing the force applied to the key cap 320, the first support member 324 will move toward the first engaging portion 3220, and the second support member 326 will move toward the third engaging portion 3222. Afterward, the first support member 324 and the second support member 326 will rotate relative to the base 322. Accordingly, during the movement of the key cap 320 relative to the base 322, the second restraining portion 3244 will not interfere with the first restraining portion 3228, and the fourth restraining portion 3264 will not interfere with the third restraining portion 3230.

Compared to the prior art, since the first support member, the second support member and the link member of the keyswitch of the invention can be assembled between the key cap and the base respectively, the keyswitch of the invention can be assembled and miniaturized easily. Besides, the link member can effectively drive the movement of opposite ends of the key cap while the keyswitch is miniaturized. When a user presses one end of the key cap, the link member can make the key cap to move up and down with respective to the base levelly. Furthermore, the restraining portions mentioned above can ensure the correct action of the first support member and the second support member.

Those skilled in the art will readily observe that numerous modifications and alterations of the device and method may be made while retaining the teachings of the invention.

What is claimed is:

1. A keyswitch comprising:

a key cap;

a base having a first restraining portion and a third restraining portion;

a first support member disposed between the key cap and the base, the first support member having a second restraining portion, the first restraining portion restraining the second restraining portion from moving in a direction perpendicular to the base;

a second support member disposed between the key cap and the base and opposite to the first support member, the second support member having a fourth restraining portion, the third restraining portion restraining the fourth restraining portion from moving in the direction perpendicular to the base; and a link member disposed between the key cap and the base;

wherein when the key cap is pressed to a bottom of the base, the second and fourth restraining portions are located under the first and third restraining portions respectively.

2. The keyswitch of claim 1, wherein the first support member has a fifth restraining portion, the second support member has a sixth restraining portion, and when the key cap is pressed to the bottom of the base, the first restraining portion restrains the fifth restraining portion from moving in a direction parallel to the base, and the third restraining portion restrains the sixth restraining portion from moving in the direction parallel to the base.

3. The keyswitch of claim 1, wherein the first support member has a first end portion slidably disposed on the base and a second end portion pivotally connected to the key cap, the second support member has a third end portion slidably disposed on the base and a fourth end portion pivotally connected to the key cap, the link member has a fifth end portion, a sixth end portion and a seventh end portion between the fifth and sixth end portions, the fifth and sixth end portions are slidably disposed on the base, the seventh end portion is pivotally connected to the key cap, and the first and second support members are located between the fifth and sixth end portions.

4. The keyswitch of claim 3, wherein the first end portion is slidable in a first direction relative to the base, the third end portion is slidable in a second direction relative to the base, the fifth and sixth end portions are slidable in a third direction relative to the base, the first direction is opposite to the second direction, and the third direction is perpendicular to the first and second directions.

5. The keyswitch of claim 3, wherein the base has a first engaging portion and a third engaging portion, the key cap has a second engaging portion and a fourth engaging portion, the first end portion is slidably disposed in the first engaging portion, the second end portion is pivotally connected to the second engaging portion, the third end portion is slidably disposed in the third engaging portion, and the fourth end portion is pivotally connected to the fourth engaging portion.

6. The keyswitch of claim 5, wherein the first restraining portion and the first engaging portion are formed integrally, and the third restraining portion and the third engaging portion are formed integrally.

7. The keyswitch of claim 5, wherein each of the second and fourth engaging portions is formed as a pivoting hole with an opening, and each of the second and fourth end portions has a pivoting shaft pivotally connected to the pivoting hole correspondingly.

8. The keyswitch of claim 3, wherein the base has a fifth engaging portion and a sixth engaging portion, the key cap has a seventh engaging portion, the fifth end portion is slidably disposed in the fifth engaging portion, the sixth end portion is slidably disposed in the sixth engaging portion, and the seventh end portion is pivotally connected to the seventh engaging portion.

9. A keyboard comprising:

a casing; and a plurality of keyswitches disposed on the casing, one of the keyswitches comprising:

a key cap;

a base having a first restraining portion and a third restraining portion;

a first support member disposed between the key cap and the base, the first support member having a second restraining portion, the first restraining portion restraining the second restraining portion from moving in a direction perpendicular to the base;

a second support member disposed between the key cap and the base and opposite to the first support member, the second support member having a fourth restraining portion, the third restraining portion restraining the fourth restraining portion from moving in the direction perpendicular to the base; and a link member disposed between the key cap and the base;

wherein when the key cap is pressed to a bottom of the base, the second and fourth restraining portions are located under the first and third restraining portions respectively.

10. The keyboard of claim 9, wherein the first support member has a fifth restraining portion, the second support member has a sixth restraining portion, and when the key cap is pressed to the bottom of the base, the first restraining portion restrains the fifth restraining portion from moving in a direction parallel to the base, and the third restraining portion restrains the sixth restraining portion from moving in the direction parallel to the base.

11. The keyboard of claim 9, wherein the first support member has a first end portion slidably disposed on the base and a second end portion pivotally connected to the key cap, the second support member has a third end portion slidably disposed on the base and a fourth end portion pivotally connected to the key cap, the link member has a fifth end portion, a sixth end portion and a seventh end portion between the fifth and sixth end portions, the fifth and sixth end portions are slidably disposed on the base, the seventh end portion is pivotally connected to the key cap, and the first and second support members are located between the fifth and sixth end portions.

12. The keyboard of claim 11, wherein the first end portion is slidable in a first direction relative to the base, the third end portion is slidable in a second direction relative to the base, the fifth and sixth end portions are slidable in a third direction relative to the base, the first direction is opposite to the second direction, and the third direction is perpendicular to the first and second directions.

13. The keyboard of claim 11, wherein the base has a first engaging portion and a third engaging portion, the key cap has a second engaging portion and a fourth engaging portion, the first end portion is slidably disposed in the first engaging portion, the second end portion is pivotally connected to the second engaging portion, the third end portion is slidably disposed in the third engaging portion, and the fourth end portion is pivotally connected to the fourth engaging portion.

14. The keyboard of claim 13, wherein the first restraining portion and the first engaging portion are formed integrally, and the third restraining portion and the third engaging portion are formed integrally.

15. The keyboard of claim 13, wherein each of the second and fourth engaging portions is formed as a pivoting hole with an opening, and each of the second and fourth end portions has a pivoting shaft pivotally connected to the pivoting hole correspondingly.

16. The keyboard of claim 11, wherein the base has a fifth engaging portion and a sixth engaging portion, the key cap has a seventh engaging portion, the fifth end portion is slidably disposed in the fifth engaging portion, the sixth end portion is slidably disposed in the sixth engaging portion, and the seventh end portion is pivotally connected to the seventh engaging portion.

* * * * *